US006722732B1

(12) United States Patent
Menne

(10) Patent No.: US 6,722,732 B1
(45) Date of Patent: Apr. 20, 2004

(54) PRIVACY ENCLOSURE SYSTEM

(75) Inventor: Thomas J. Menne, Center City, MN (US)

(73) Assignee: Premier Marine, Inc., Wyoming, MN (US)

( * ) Notice: Subject to any disclaimer, the term of this patent is extended or adjusted under 35 U.S.C. 154(b) by 0 days.

(21) Appl. No.: 10/308,942

(22) Filed: Dec. 3, 2002

(51) Int. Cl.[7] ..... A47C 13/00; A47C 29/00; A47H 1/00; B63B 17/00

(52) U.S. Cl. ..... 297/129; 297/184.1; 297/184.14; 160/333; 114/363

(58) Field of Search ..... 297/129, 184.1, 297/184.14; 4/599, 600; 114/363, 343; 160/330, 333, 336

(56) References Cited

U.S. PATENT DOCUMENTS

| | | | | |
|---|---|---|---|---|
| 689,164 | A | | 12/1901 | Castle |
| 1,145,568 | A | | 7/1915 | Dardano |
| 3,027,189 | A | * | 3/1962 | Scott ..... 297/184.14 |
| 3,884,522 | A | * | 5/1975 | Arima et al. ..... 297/63 |
| 4,536,902 | A | | 8/1985 | McGill |
| 4,710,989 | A | | 12/1987 | Grenthe |
| 4,854,261 | A | | 8/1989 | Goldsmith |
| 4,883,016 | A | | 11/1989 | Larson |
| 4,974,265 | A | | 12/1990 | Maggio |
| 4,979,242 | A | | 12/1990 | Maggio |
| 5,029,348 | A | | 7/1991 | Boren |
| 5,226,689 | A | | 7/1993 | Roe et al. |
| 5,331,917 | A | | 7/1994 | Magers |
| 5,379,466 | A | | 1/1995 | Davies |
| 5,544,369 | A | | 8/1996 | Roberts |
| 5,671,487 | A | | 9/1997 | Chen |
| 5,682,622 | A | | 11/1997 | Tagg |
| 5,862,540 | A | | 1/1999 | Chuan |
| 5,974,597 | A | | 11/1999 | Conwell |
| 6,263,825 | B1 | | 7/2001 | Davidson |
| 6,283,059 | B1 | | 9/2001 | Scully, Jr. |
| 6,302,053 | B1 | | 10/2001 | Tomczak et al. |
| 6,327,719 | B1 | | 12/2001 | Lobertmann et al. |
| 6,357,379 | B1 | | 3/2002 | Murphy, Jr. |
| 6,374,432 | B1 | | 4/2002 | Morris |

FOREIGN PATENT DOCUMENTS

| | | |
|---|---|---|
| GB | 349769 | 6/1931 |
| GB | 2052960 | 2/1981 |
| SE | WO 93/04913 | 3/1993 |

* cited by examiner

*Primary Examiner*—Peter M. Cuomo
*Assistant Examiner*—Sarah C. Burnham
(74) *Attorney, Agent, or Firm*—Hugh D. Jaeger

(57) ABSTRACT

A privacy enclosure system including a positionable seat which transforms into a privacy enclosure. A positionable seat containing a nested positionable privacy curtain support and attached privacy curtain positionably rotates about a support structure where subsequently the positionable privacy curtain support is positionally rotated to an upright position to allow full suspension of an attached privacy curtain therefrom.

1 Claim, 6 Drawing Sheets

PRIVACY ENCLOSURE SYSTEM

This utility patent application is related to design patent application Ser. No. 29/171,922 filed Dec. 3, 2002, by the same inventor.

BACKGROUND OF THE INVENTION

1. Field of the Invention

The present invention is for a privacy enclosure system, and more particularly is for a privacy enclosure system having expandable structure which can be used on a boat, a car or anywhere privacy is required.

2. Description of the Prior Art

None.

SUMMARY OF THE INVENTION

The general purpose of the present invention is to provide a privacy enclosure system. The privacy enclosure system can be utilized as a privacy enclosure for gaining privacy, such as for, but not limited to, changing clothes or swimming suits on a boat or other recreational vehicle. Also, the privacy enclosure system can be used with a portable toilet unit which can be placed in the lower region of the privacy enclosure. The present invention is provided as a positionable seat which expands and transforms into a privacy structure where the expandable structure and an attached privacy curtain provide for personal privacy. Additionally, certain structural components of the privacy enclosure system can also be utilized for positioning of structures other than for the purposes of privacy, such as table tops, radio and stereo enclosures, food or drink containment or dispensing devices, storage structures, and a host of other devices or structures.

The privacy enclosure system includes a positionable seat rotationally secured to a support structure. The positionable seat includes intersecting cavities in which a positionable privacy curtain support and an attached privacy curtain nest or reside when not in use. The positionable seat can be pivoted about pivot mounts located at the upper area of the support structure where such pivoting places the positionable seat at an elevated position to present the positionable privacy curtain support and attached privacy curtain for further deployment by the user. The positionable privacy curtain support is then pivoted about pivot mounts located in the positionable seat to be further positioned to the fully deployed position, whereby the privacy curtain can be fully utilized. Pneumatic damper tubes assist in maintaining the position of the positionable seat and the positionable privacy curtain support in the erected position and in the nested or stowed position.

According to one embodiment of the present invention, there is provided a privacy enclosure system including a support structure having a base and opposing support panels extending perpendicularly therefrom, a pivot rod extending through the upper region of each of the opposing support panels, a positionable seat pivotally attached to the opposing support panels by the pivot rod, a bottom cavity in the positionable seat formed in part by opposing side panels, a mid-panel and a partial bottom panel, a rear cavity formed in part by a back panel and the opposing side panels, a positionable privacy curtain support which can align in the bottom cavity and rear cavity and which is pivotally attached to the forward and lower region of the opposing side panels, a privacy curtain attached to the positionable privacy curtain support, opposing pneumatic damper tubes pivotally attached between the upper regions of the opposing support structure support panels and the rear of the opposing side panels, opposing pneumatic damper tubes pivotally attached between the lower regions of the opposing side panels and opposing sides of the positionable privacy curtain support, recesses in the rearward edges of the opposing side panels which accommodate opposing pneumatic damper tubes pivotally attached between the upper regions of the opposing support structure support panels and the rear of the opposing side panels, a bottom seat cushion secured to the opposing side panels and a front panel, and a seat back cushion aligned to a seat panel and the rear edge of the bottom seat cushion and between the rearward portions of the side panels.

One significant aspect and feature of the present invention is a privacy enclosure system suitably disguised as part of and within and about the confines of a seat structure.

Another significant aspect and feature of the present invention is a seat which expandably transforms into a privacy enclosure.

An additional significant aspect and feature of the present invention is a privacy enclosure system having a positionable seat which is pivotally positioned about the top region of a support structure.

Another significant aspect and feature of the present invention is a privacy enclosure system having a positionable seat incorporating a rear cavity and a bottom cavity which mutually intersect.

Still another significant aspect and feature of the present invention is a privacy enclosure system including a pivotally positionable privacy curtain support and attached privacy curtain.

Yet another significant aspect and feature of the present invention is a privacy enclosure system wherein the positionable privacy curtain support and attached privacy curtain are stored in or nest in the rear cavity and a bottom cavity of a positionable seat.

A further significant aspect and feature of the present invention is a privacy enclosure system including a pivotally positionable privacy curtain support and attached privacy curtain which can be rotatably positioned to provide for an erected privacy enclosure.

Having thus mentioned certain significant aspects and features of the present invention, it is the principal object of the present invention to provide a privacy enclosure system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
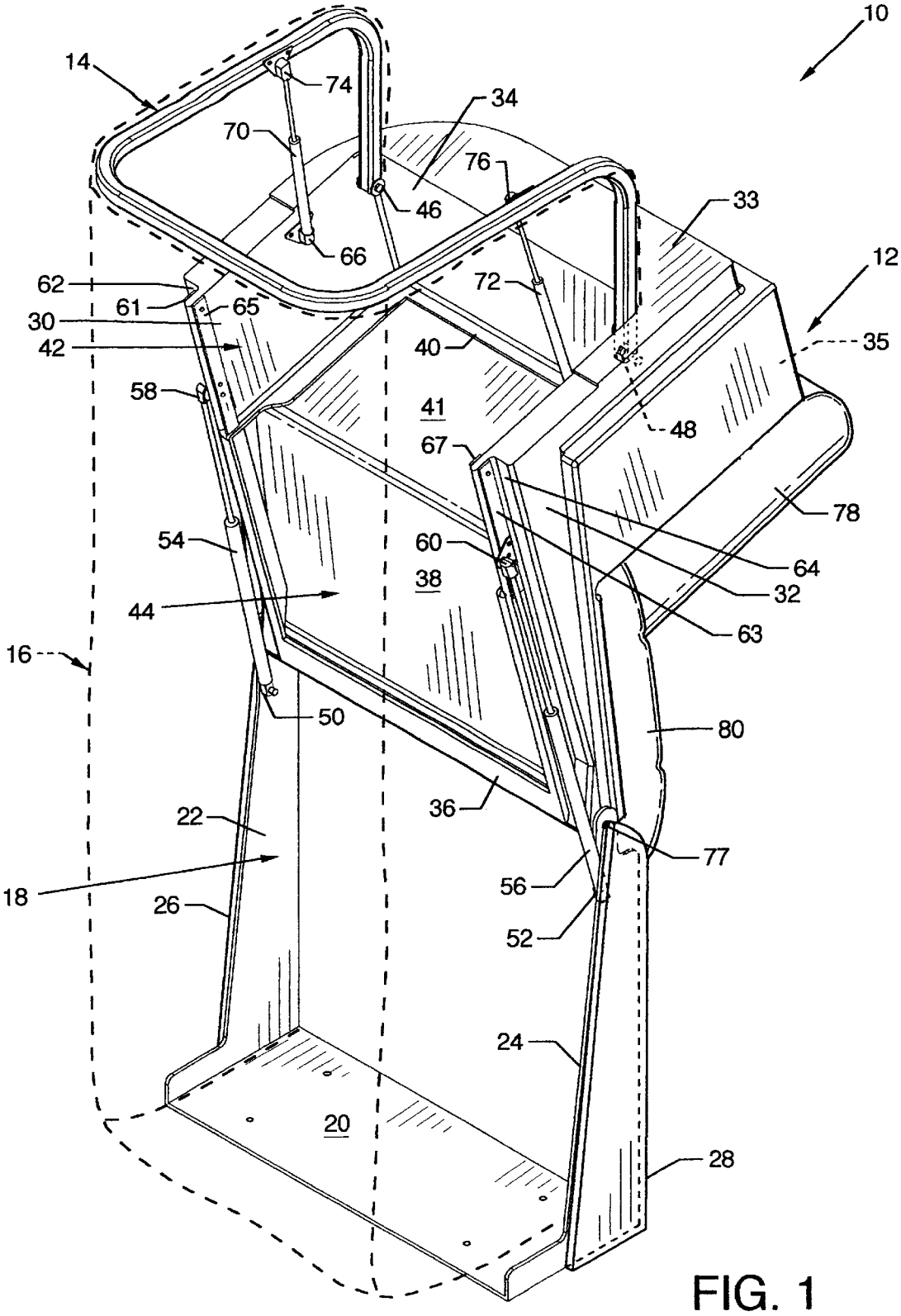
FIG. 1 is an isometric view of a privacy enclosure system, the present invention, in an extended and deployed position.
Figure 2:
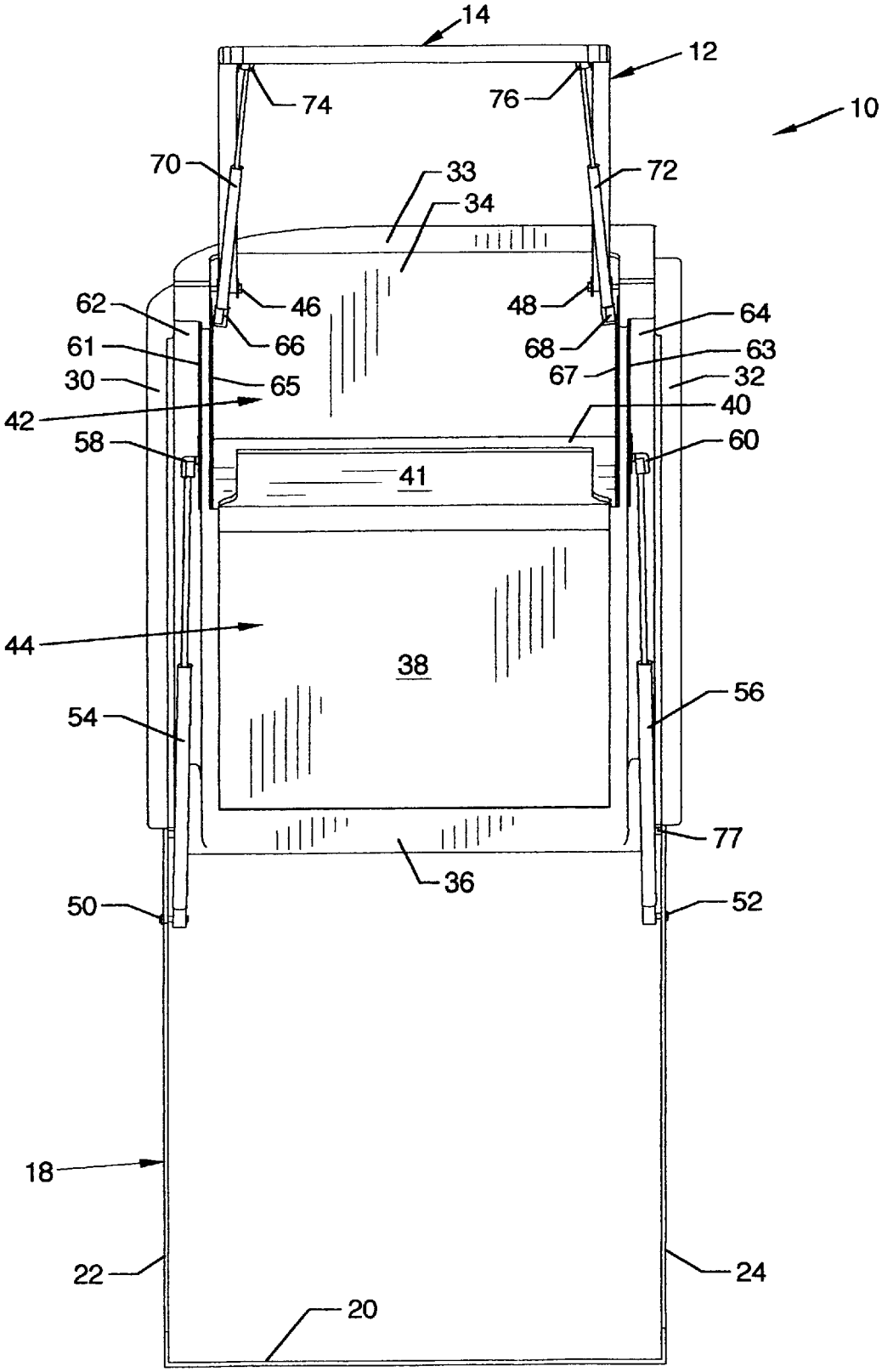
FIG. 2 is a front view of a privacy enclosure system in an extended and deployed position.
Figure 3:
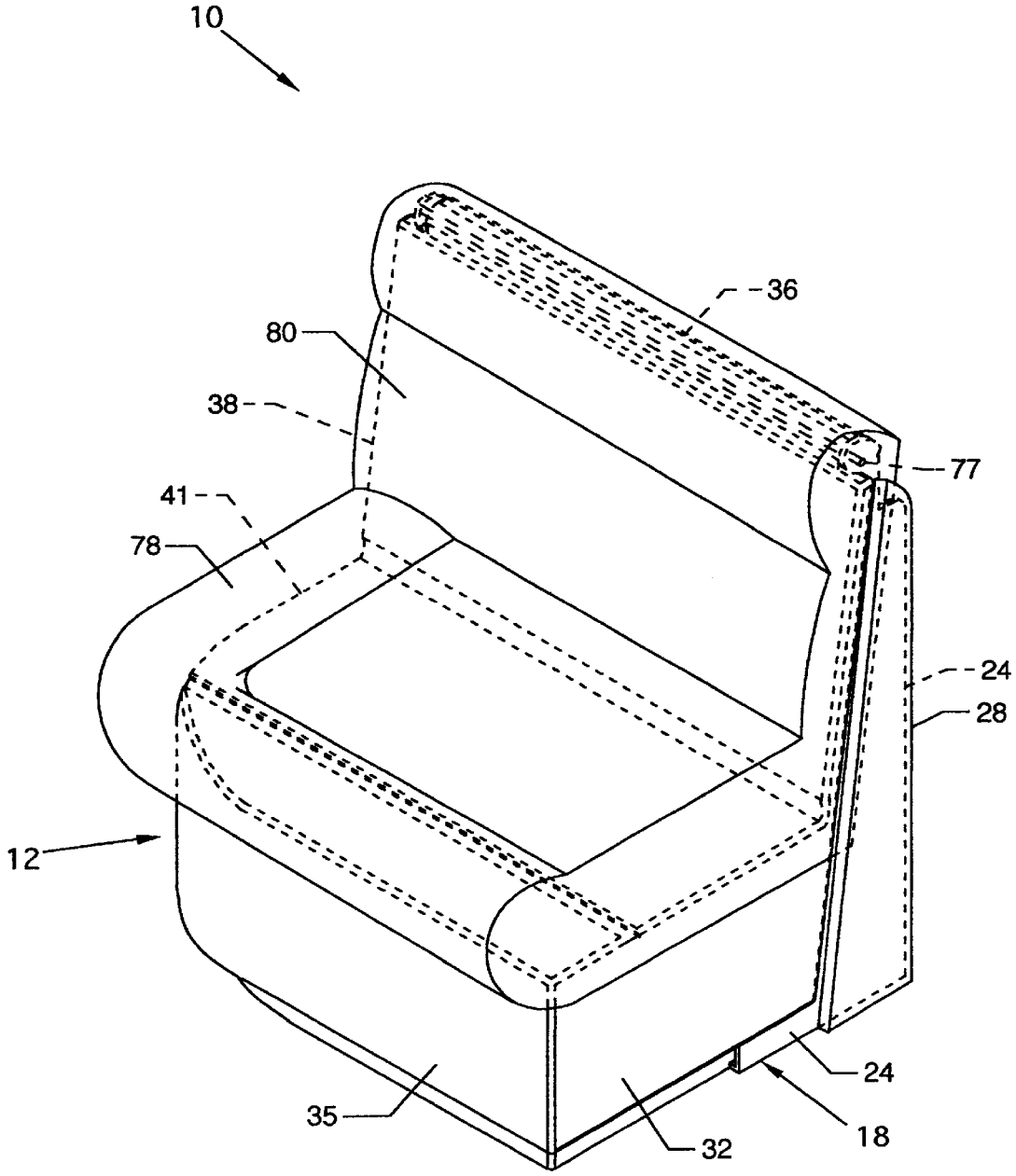
FIG. 3 is an isometric view of the privacy enclosure in use as a seat.

FIGS. 1 and 2 illustrate isometric and front views of a privacy enclosure system 10, the present invention, shown being extended and deployed from a stowed and static position, such as for use as a seat as shown in FIG. 3, to be utilized as a privacy enclosure. A positionable seat 12, in which a positionable privacy curtain support 14 and an attached privacy curtain 16, represented by dashed lines in FIG. 1, can be housed, is pivotally secured to a support structure 18.

The support structure 18 includes a base 20 having opposing support panels 22 and 24 extending perpendicularly therefrom. The base 20 and opposing side panels 22 and 24 are illustrated as being made as one piece, but these three parts could be made as separate pieces and then suitably joined together. Opposing cover panels 26 and 28, which can be padded or constructed of soft and flexible material, secure over and about the support panels 22 and 24. The positionable seat 12 is illustrated in the deployed and inverted position. Locational reference is made to regions of the components forming the positionable seat 12 such as upper, lower, upward, forward or rearward regions or areas of the positionable seat 12 which is inverted for purposes of illustration. Such locational reference and nomenclature refers to and is understood to be the structure orientation as found in the nondeployed or nonextended stowed and static position pictured in FIGS. 3 and 4. The positionable seat 12 includes configured and opposing side panels 30 and 32, a mid-panel 34 extending between the opposing side panels 30 and 32, a configured front panel 35 extending substantially between the forward regions of the opposing side panels 30 and 32, a multi-level bottom panel 33 extending between and along the forward and lower regions of the side panels 30 and 32, the lower region of the front panel 35 and the lower region of the mid-panel 34, as well as extending along the lower edge regions of the side panels 30 and 32, a U-shaped back frame 36 extending substantially between a portion of the rearward regions of the side panels 30 and 32, a back panel 38 extending between the rearward and upwardly extending regions of the side panels 30 and 32 and a portion of the U-shaped back frame 36, a partial bottom panel 40 extending between the side panels 30 and 32 and the mid-panel 34, and a horizontally situated seat panel 41, visible between the members of the U-shaped partial bottom panel 40. The positionable seat 12 also includes intersecting bottom and rear cavities 42 and 44, respectively, where the bottom cavity 42 is formed in part and mostly by a region bounded by the opposing side panels 30 and 32, the mid-panel 34 and the partial bottom panel 40, and where the rear cavity 44 is formed in part and mostly by a region bounded by the back panel 38, the rearward portions of the opposing side panels 30 and 32, and the U-shaped back frame 36. The bottom cavity 42 and the rear cavity 44 intersect at approximately a right angle to accommodate the positionable privacy curtain support 14 and the attached privacy curtain 16, as illustrated in FIG. 5. The positionable seat 12 also includes pivot pins 46 and 48 extending through the ends of the positionable privacy curtain support 14 and into side panels 30 and 32 for pivotal attachment of the positionable privacy curtain support 14 and attached privacy curtain 16 to the side panels 30 and 32.

Pneumatic tube dampers are incorporated to assist in smooth operation and extended or stowed support of the positionable seat 12 with respect to the support structure 18 and of the positionable privacy curtain support 14 with respect to the positionable seat 12. Pivot mounts 50 and 52 secure to the inner surfaces of the support panels 22 and 24, respectively, for pivotal attachment of one end of each of pneumatic tube dampers 54 and 56 to the support structure 18. The remaining ends of the pneumatic tube dampers 54 and 56 pivotally attach to pivot mounts 58 and 60 which are located in recesses 62 and 64 at the rearward edges of the side panels 30 and 32. The ends of the pneumatic tube dampers 54 and 56 may be reversed for optional mounting. Optionally, mounting support plates 61 and 63 and opposing backing plates 65 and 67 can be located about the rear edges of the side panels 30 and 32 in or near the recesses 62 and 64 to accommodate mounting of the pivot mounts 58 and 60. The recesses 62 and 64 accommodate the various extended or contracted positional states of the pneumatic tube dampers 54 and 56, respectively, when the positionable seat 12 is fully extended, partially extended, or in the stowed position. Pivot mounts 66 and 68 secure to the inner surfaces of the side panels 30 and 32, respectively, for pivotal attachment of one end of each of pneumatic tube dampers 70 and 72 to the positionable seat 12. The remaining ends of the pneumatic tube dampers 70 and 72 pivotally attach to pivot mounts 74 and 76 which are located on the inner surface of the positionable privacy curtain support 14. A pivot rod 77 extends through the upper regions of the support panels 22 and 24 of the support structure 18 and through the back frame 36 of the positionable seat 12 to pivotally attach the positionable seat 12 to the support structure 18. The positionable seat 12 also includes a bottom seat cushion 78 which extends between the side panels 30 and 32 and mates and secures to the upper surface of the seat panel 41. The positionable seat 12 also includes a seat back cushion 80 which extends between the side panels 30 and 32 and mates and secures to the back panel 38.

FIG. 3 illustrates the nondeployed or static state of the privacy enclosure system 10 where the privacy enclosure system 10 is utilized as a seat. The positionable seat 12, which includes the previously described positionable privacy curtain support 14 and the attached privacy curtain 16, is held in position with the support structure 18 partly by the pivot rod 77 common to both the positionable seat 12 and the support structure 18.

Figure 4:
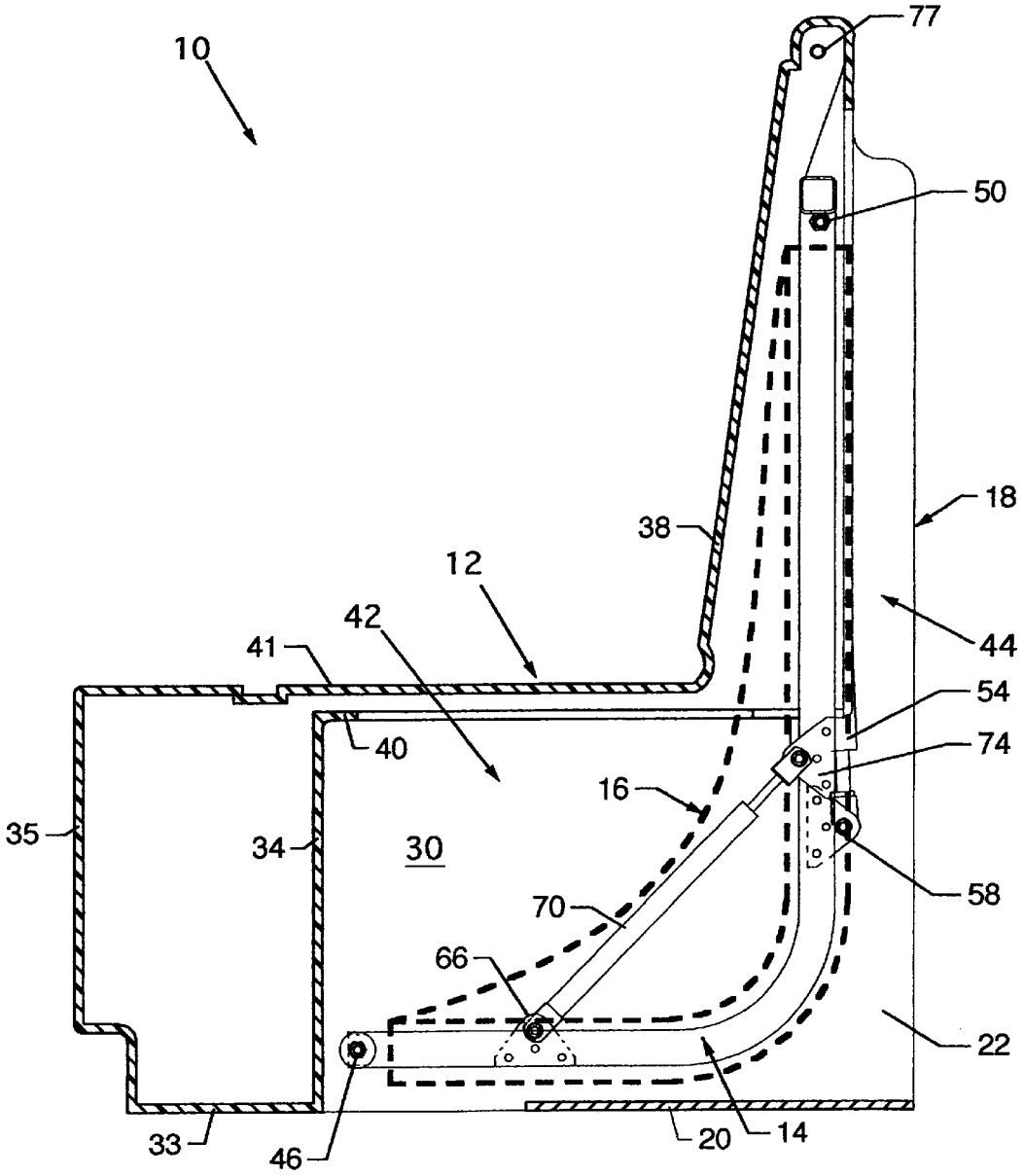
FIG. 4 is a cross section side view of the privacy enclosure in use as a seat.
Figure 5:
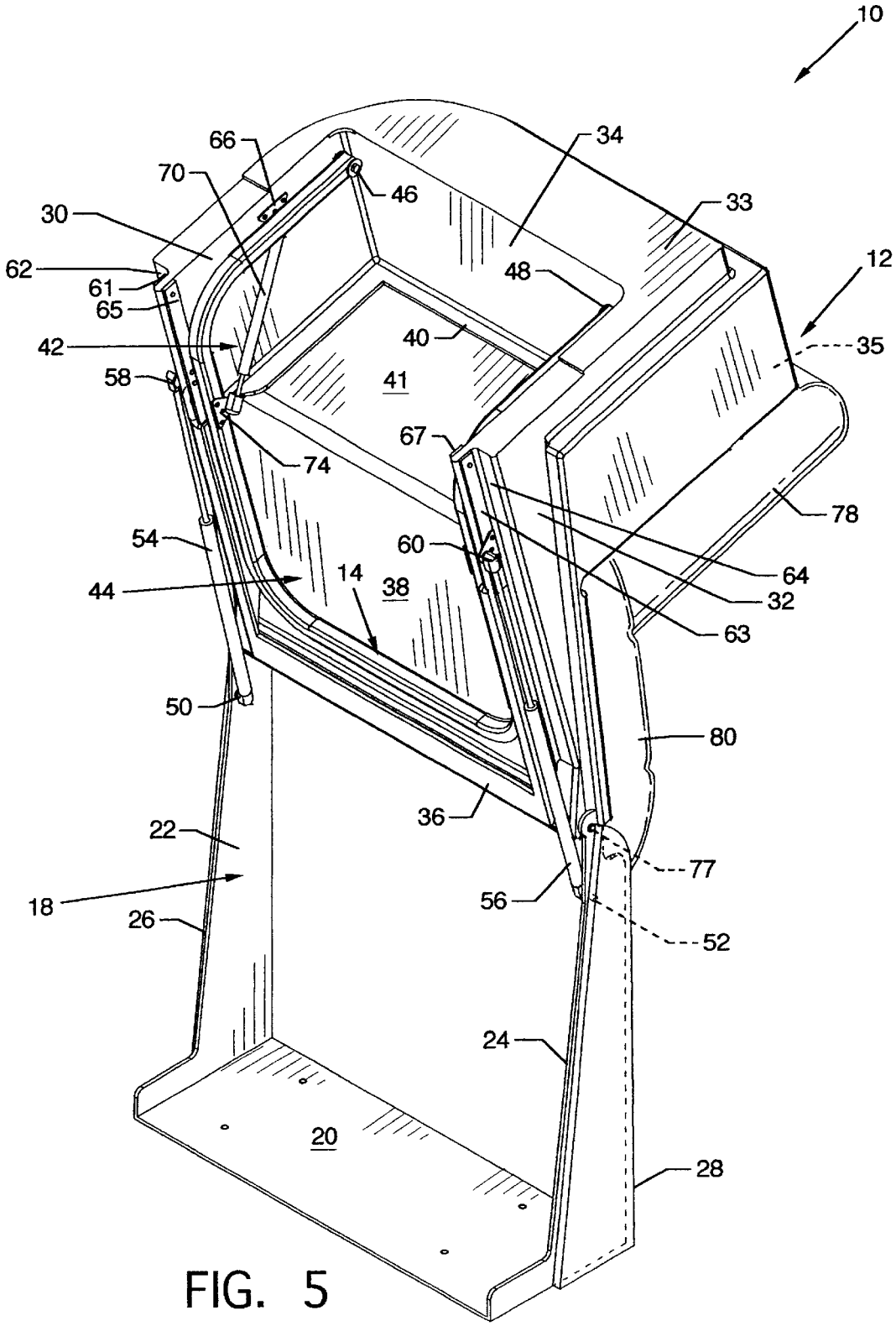
FIG. 5 is an isometric view of the privacy enclosure system where the positionable seat is rotated to its most upright position; and, FIG. 6 illustrates the privacy enclosure system in the fully extended and deployed position.

FIG. 4 is a cross section view of the privacy enclosure system 10 showing the position of the positionable privacy curtain support 14 and the attached privacy curtain 16 where the privacy enclosure system 10 is utilized as a seat. The privacy curtain 16 is shown in dashed lines attached to the positionable privacy curtain support 14 where the positionable privacy curtain support 14 and the attached privacy curtain 16 are stored in the rear cavity 44 and the bottom cavity 42 of the positionable seat 12.

FIG. 5 is an isometric view of the privacy enclosure system 10 where the positionable seat 12 is fully rotated to the most upright position. The positionable privacy curtain support 14 is shown in the stowed position where the positionable privacy curtain support 14 and the attached privacy curtain 16, shown in dashed lines, are nested and stored in the rear cavity 44 and the bottom cavity 42 of the positionable seat 12.

Figure 6:
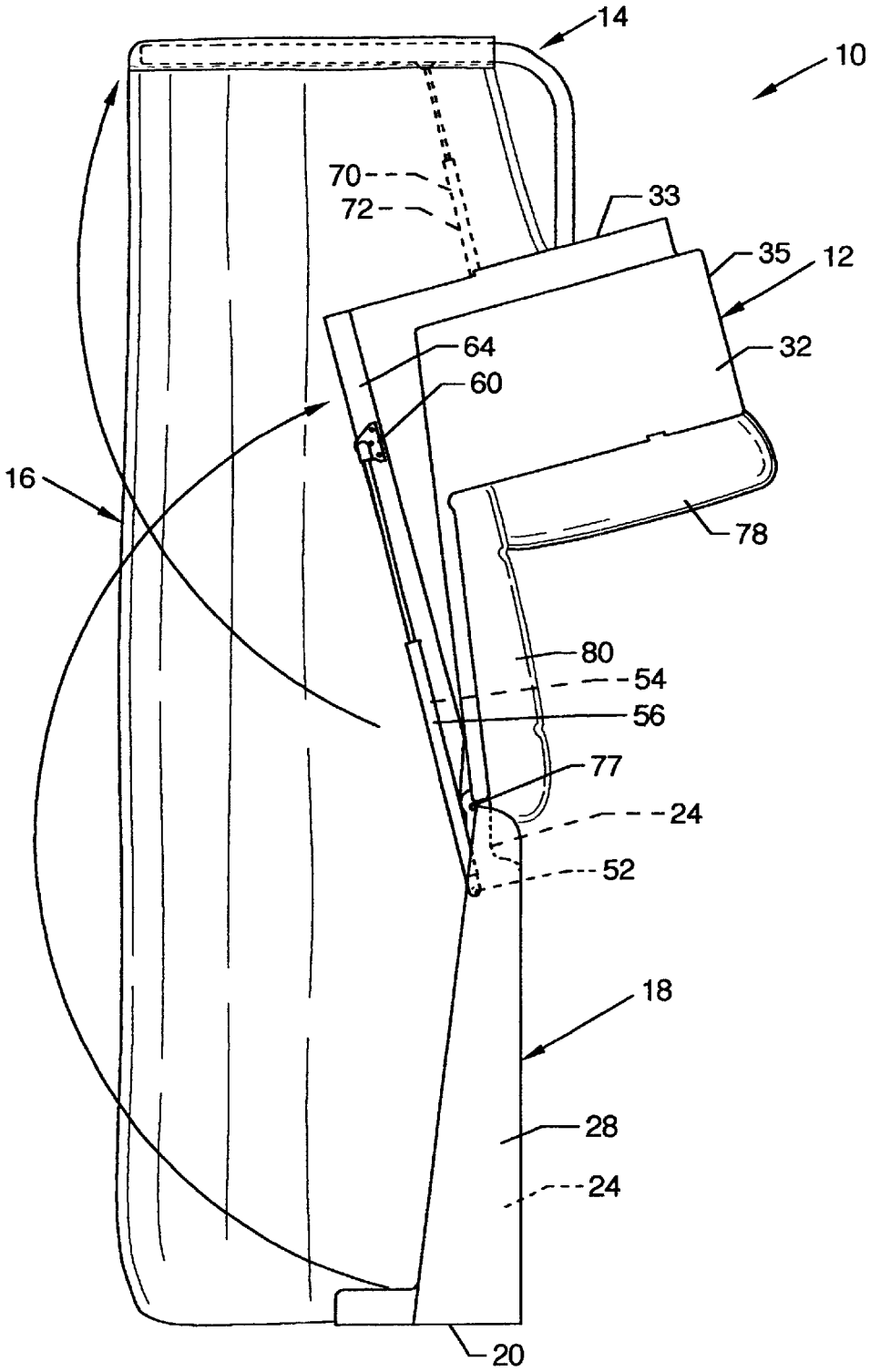

FIG. 6 illustrates the privacy enclosure system 10 in the fully extended and deployed position where the positionable seat 12 has been rotatably positioned about the pivot rod 77 to the most upright position and where the positionable privacy curtain support 14 has been rotatably positioned about the pivot pins 46 and 48 (FIG. 2) to the most upright position to allow the privacy curtain 16 to be fully suspended for use from the positionable privacy curtain support 14 by gravitational assistance.

MODE OF OPERATION

Various figures illustrate the mode of operation of the privacy enclosure system 10. The privacy enclosure system 10 can be utilized simply as a seat, such as used in, but not limited to, a boat, a recreational vehicle, at a camp, at the beach, or any place where simply seating is desired. The privacy enclosure system 10 can also be used to provide a privacy enclosure for changing clothing, for use of a portable toilet and the like, or for numerous other activities where privacy is desired. Use of the privacy curtain 16 to provide privacy is initiated by a simple transformation of the privacy enclosure system 10 from use as a seat to use as a privacy enclosure. Such erectional transformation is initiated by grasping the positionable seat 12 such as by the edge of the cushion 78 or by grasping beneath the configured front panel 35 shown in FIG. 3 and exerting upward pressure to rotate and establish a new position of the positionable seat 12 about the pivot rod 77 to the upright and overcenter position as shown in FIG. 5. The pneumatic tube dampers 54 and 56 assist in smooth rotational operation of the positionable seat 12 and serve to stabilize the position of the positionable seat 12 when in the most upright position. The pneumatic tube dampers 54 and 56 also serve to stabilize the motion of the positionable seat 12 when collapsing the privacy enclosure system 10 for utilization as a seat. Transformation for use as a privacy enclosure continues with the manual grasping and positioning of the positionable privacy curtain support 14 and attached privacy curtain 16 about the pivot pins 46 and 48 to the most upright position, such as shown in FIGS. 1 and 6, to allow full downward deployment, with the assistance of gravity, of the privacy curtain 16. The pneumatic tube dampers 70 and 72 provide for smooth operational rotation of the positionable privacy curtain support 14 and provide for support of the positionable privacy curtain support 14 and attached privacy curtain 16 in the extended and deployed position. Stowing of the privacy enclosure system 10 is easily accomplished by reversing the erection procedure. It is to be appreciated that the features of the invention may also be incorporated with or without the use of the positionable privacy curtain support 14 and attached privacy curtain 16. For example and for purposes of illustration, teachings of the invention could be used to provide a seat which could transform to a portable bar, a computer center, a table top, a radio or stereo center, a navigation center, a communication center, an ice box, a baby changing station, and other uses limited only by the imagination.

Various modifications can be made to the present invention without departing from the apparent scope hereof.

| PARTS LIST | |
|---|---|
| 10 | privacy enclosure system |
| 12 | positionable seat |
| 14 | positionable privacy curtain support |
| 16 | privacy curtain |
| 18 | support structure |
| 20 | base |

-continued

| PARTS LIST | |
|---|---|
| 22 | support panel |
| 24 | support panel |
| 26 | cover panel |
| 28 | cover panel |
| 30 | side panel |
| 32 | side panel |
| 33 | bottom panel |
| 34 | mid-panel |
| 35 | front panel |
| 36 | back frame |
| 38 | back panel |
| 40 | partial bottom panel |
| 41 | seat panel |
| 42 | bottom cavity |
| 44 | rear cavity |
| 46 | pivot pin |
| 48 | pivot pin |
| 50 | pivot mount |
| 52 | pivot mount |
| 54 | pneumatic tube damper |
| 56 | pneumatic tube damper |
| 58 | pivot mount |
| 60 | pivot mount |
| 61 | mounting support plate |
| 62 | recess |
| 63 | mounting support plate |
| 64 | recess |
| 65 | backing plate |
| 66 | pivot mount |
| 67 | backing plate |
| 68 | pivot mount |
| 70 | pneumatic tube damper |
| 72 | pneumatic tube damper |
| 74 | pivot mount |
| 76 | pivot mount |
| 77 | pivot rod |
| 78 | bottom seat cushion |
| 80 | seat back cushion |

What is claimed is:

1. A privacy enclosure system comprising:

a. a support structure having a base fastenable to an understructure and opposing support panels extending perpendicularly from the base, the opposing support panels each having an upper region;

b. a pivot rod extending through the upper region of each of the opposing support panels;

c. a positionable seat pivotally attached to the opposing support panels by the pivot rod, the positionable seat having opposing side panels each with a rear including a rearward edge and each with a forward and lower region, a mid-panel, a partial bottom panel, and a back panel;

d. a bottom cavity in the positionable seat formed in part by the opposing side panels, the mid-panel and the partial bottom panel;

e. a rear cavity in the positionable seat formed in part by the back panel and the opposing side panels;

f. a positionable privacy curtain support which can align in the bottom cavity and the rear cavity and which has opposing sides that are pivotally attached to the forward and lower regions of the opposing side panels;

g. a privacy curtain attached to the positionable privacy curtain support;

h. opposing pneumatic tube dampers each respectively pivotally attached between the upper region of one of the opposing support panels and the rear of one of the opposing side panels;

i. opposing pneumatic tube dampers each respectively pivotally attached between the forward and lower region of one of the opposing side panels and the opposing sides of the positionable privacy curtain support, recesses in the rearward edges of the opposing side panels which accommodate the opposing pneumatic tube dampers each respectively pivotally attached between the upper region of one of the opposing support panels and the rear of one of the opposing side panels;

j. a bottom seat cushion secured to the opposing side panels; and, k. a seat back cushion aligned to the bottom seat cushion and extending between the opposing side panels.

* * * * *